US008757838B2

(12) United States Patent
Hente et al.

(10) Patent No.: US 8,757,838 B2
(45) Date of Patent: Jun. 24, 2014

(54) LIGHTING DEVICE COMPRISING A PLURALITY OF LIGHT EMITTING TILES

(75) Inventors: Dirk Hente, Wuerselen (DE); Vincent Johannes Jacobus Van Montfort, Sittard (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/520,591

(22) PCT Filed: Jan. 12, 2011

(86) PCT No.: PCT/IB2011/050126
§ 371 (c)(1),
(2), (4) Date: Jul. 5, 2012

(87) PCT Pub. No.: WO2011/089536
PCT Pub. Date: Jul. 28, 2011

(65) Prior Publication Data

US 2012/0281412 A1 Nov. 8, 2012

(30) Foreign Application Priority Data

Jan. 22, 2010 (EP) ..... 10151369

(51) Int. Cl.
*F21V 21/00* (2006.01)

(52) U.S. Cl.
USPC ..... 362/249.02; 362/249.01; 362/249.05; 362/249.13

(58) Field of Classification Search
CPC ..... F21S 2/00; F21S 2/005; F21V 19/0025; F21V 21/002; G09F 9/302; G09F 9/3023; G09F 9/3026; G09G 2300/026; H01R 13/514
USPC ..... 345/1.3; 362/249.03, 249.05, 646, 362/249.01, 249.02, 249.13
See application file for complete search history.

(56) References Cited

U.S. PATENT DOCUMENTS

| | | | | |
|---|---|---|---|---|
| 5,591,984 | A * | 1/1997 | Drucker | 250/551 |
| 6,565,231 | B1 | 5/2003 | Cok | |
| 2005/0116667 | A1 * | 6/2005 | Mueller et al. | 315/312 |
| 2005/0134525 | A1 | 6/2005 | Tanghe et al. | |
| 2005/0248935 | A1 | 11/2005 | Strip et al. | |
| 2006/0262533 | A1 * | 11/2006 | Lin et al. | 362/249 |

(Continued)

FOREIGN PATENT DOCUMENTS

| | | | |
|---|---|---|---|
| DE | 4427691 | C1 * | 10/1995 |
| DE | 102007044567 | A1 | 3/2009 |

(Continued)

OTHER PUBLICATIONS

Machine translation of DE 4427691 C1, retrieved Aug. 21, 2013.*

*Primary Examiner* — Nimeshkumar Patel
*Assistant Examiner* — Steven Horikoshi
(74) *Attorney, Agent, or Firm* — Yuliya Mathis

(57) ABSTRACT

The invention relates to a lighting device including a plurality of light emitting tiles. Each light emitting tile has at least one interface, which is adapted for signal transmission. By adding a connection element in between two neighboring interfaces of two neighboring light emitting tiles, the two light emitting tiles are connected in a daisy chain bus system. The daisy chain bus system is adapted for transmitting signals, the signals being indicative of power and/or color of each light emitting tile.

9 Claims, 6 Drawing Sheets

(56) References Cited

U.S. PATENT DOCUMENTS

| | | | | |
|---|---|---|---|---|
| 2007/0291483 | A1* | 12/2007 | Lys | 362/227 |
| 2008/0220631 | A1* | 9/2008 | Isoda et al. | 439/74 |
| 2009/0154156 | A1 | 6/2009 | Lo et al. | |
| 2009/0302771 | A1 | 12/2009 | Peng | |

FOREIGN PATENT DOCUMENTS

| | | | |
|---|---|---|---|
| GB | 2244358 | A | 11/1991 |
| WO | 2008001274 | A2 | 1/2008 |
| WO | 2009011898 | A2 | 1/2009 |
| WO | 2009095867 | A2 | 8/2009 |

* cited by examiner

LIGHTING DEVICE COMPRISING A PLURALITY OF LIGHT EMITTING TILES

FIELD OF THE INVENTION

The invention relates to the field of lighting devices, more particularly to lighting devices comprising a plurality of light emitting tiles.

BACKGROUND OF THE INVENTION

Lighting devices with a plurality of light emitting tiles are known for example from US 2005 248935 A1.

The plurality of light emitting tiles may thereby have various shapes and every side of a tile comprises an interface that allows connecting the tiles with each other using a connection element. All tiles are connected to a power and communication bus. Depending upon how the tiles are connected, the shape of the lighting device may be changed.

SUMMARY OF THE INVENTION

It is an object of the invention to provide an improved lighting device with a plurality of light emitting tiles.

This object is achieved by a lighting device comprising a plurality of light emitting tiles. Each one of the plurality of light emitting tiles has at least one interface. The at least one interface is adapted for signal transmission. Each tile has electrical conductors connected to the at least one interface. The at least one interface is adapted to connect two light emitting tiles of the plurality of light emitting tiles with each other by using a connection element. The plurality of light emitting tiles is connected by means of the at least one interface and connection elements to form a light emitting surface connected by a daisy chain bus system. The daisy chain bus system is adapted for transmitting signals, wherein the signals are indicative of power and/or color of each light emitting tile.

In other words, the lighting device with the plurality of light emitting tiles is freely configurable in at least two dimensions. It is also possible that the lighting device is freely configurable in all three dimensions. Transmission of the signals may be performed by power line communication. This means that the light emitting tiles are provided with power over the same lines as the signals being indicative of power and/or color of each light emitting tile. The power supply of the light emitting tiles may also be realized externally. Thus, each light emitting tile is connected to a power line and to the signal transmission line. The signal transmission line is arranged in a daisy chain bus scheme.

In case of power line communication the signal being indicative of power and/or color of each light emitting tile is transmitted via pulses of different pulse widths. By rectifying the signal the power supply can be realized. The varying frequency of the pulses is not visible to the user's eye.

According to embodiments of the invention the light emitting tiles comprise organic light emitting diodes or light emitting diodes. Organic light emitting diodes and light emitting diodes are preferably used because they are easy to install and cost effective.

Embodiments of the invention are advantageous because the user can design the lighting device by rearranging the light emitting tiles. By using a daisy chain bus system each tile can be connected to each other tile and the user is completely free in designing the lighting device as long as the light emitting tiles are connected by the daisy chain bus system.

According to embodiments of the invention the light emitting tiles have various shapes. This is advantageous because the user is given even more freedom in designing the lighting device.

According to embodiments of the invention the electrical conductors in each tile of the plurality of light emitting tiles are arranged according to a daisy chain bus scheme. In other words the conductors of each tile form in themselves a daisy chain bus. Each of the at least one interface comprises a switch. The daisy chain bus of one tile of the plurality of light emitting tiles is closed only if each switch is closed. In other words each tile comprises conductors in a daisy chain bus, the conductors being connected by switches in the at least one interface. The switch of the at least one interface is opened when a connection element is connected to the at least one interface. Per open switch the daisy chain bus of each tile of the plurality of light emitting tiles has one input and one output port. The input and the output port are connected to the connection element.

This means, that when a connection element is connected to an interface the daisy chain bus of the tile is opened and has an input and an output port. Via the connection element the input port of a first tile is connected to an output port of the second tile and vice versa. By connecting neighboring tiles in this way a daisy chain bus leading through every tile of the lighting device is realized. By adding a connection element and a light emitting tile or by rearranging a connection element and a light emitting tile the shape of the lighting device can easily be changed.

According to embodiments of the invention the switch is a mechanical switch. This is advantageous because the switch is automatically opened when the connection element is connected to the at least one interface. It is not possible that the switch is closed when a connection element is connected to the at least one interface. This is advantageous because a mechanical switch is highly reliable.

According to embodiments of the invention the switch is an electrical switch. This is advantageous because the electrical switch can be controlled externally. The switch may be controlled by a controller being located in the same light emitting tile as the switch or by a central control unit. The switch can easily be switched electronically without detaching a tile or a connection element.

According to embodiments of the invention each light emitting tile comprises a controller connected to the daisy chain bus system. This controller controls the power and/or the color of the light emitting tile, in which the controller is located. Thus, each light emitting tile has its own controller. The controller receives signals being indicative of the power and/or the color of the light emitting tile and controls the power and/or the color according to this signal. The signal may be transmitted to each controller and one single controller is addressed by an identification number being encoded into the signal.

According to embodiments of the invention a central control unit is connected to the daisy chain bus system, the central control unit being adapted to send signals to the controllers of the light emitting tiles via the daisy chain bus system, the signals being indicative of power and/or color of the light emitting tiles. In other words the central control unit sends signals to the plurality of light emitting tiles and addresses certain controllers of certain light emitting tiles and sets the power and/or color of the light of the light emitting.

When a controller of a light emitting tile receives a signal which is addressed to it, the controller changes the power and/or the color of the light emitting tile according to the values being transmitted to the controller by the signal. The signal may also be indicative for not changing the power and/or the color of the light emitting tile. For changing the power the controller may change the external power supply or in case of a power line communication the controller may change the power being transmitted to the light emitting tile by the power line communication line.

According to embodiments of the invention the control unit comprises a display. The display is adapted to indicate if the light emitting tiles are connected properly. This is advantageous for indicating to a user if the light emitting tiles are connected properly. If for example a user changes the arrangement of light emitting tiles he may not arrange them properly and the daisy chain bus may be destructed. If so, the user is warned by the display and thus the user can change the arrangement of the light emitting tiles.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Like numbered elements in these Figs. are either identical elements or perform the same function. Elements which have been discussed previously will not necessarily be discussed in later Figs. if the function is identical.

Figure 1:
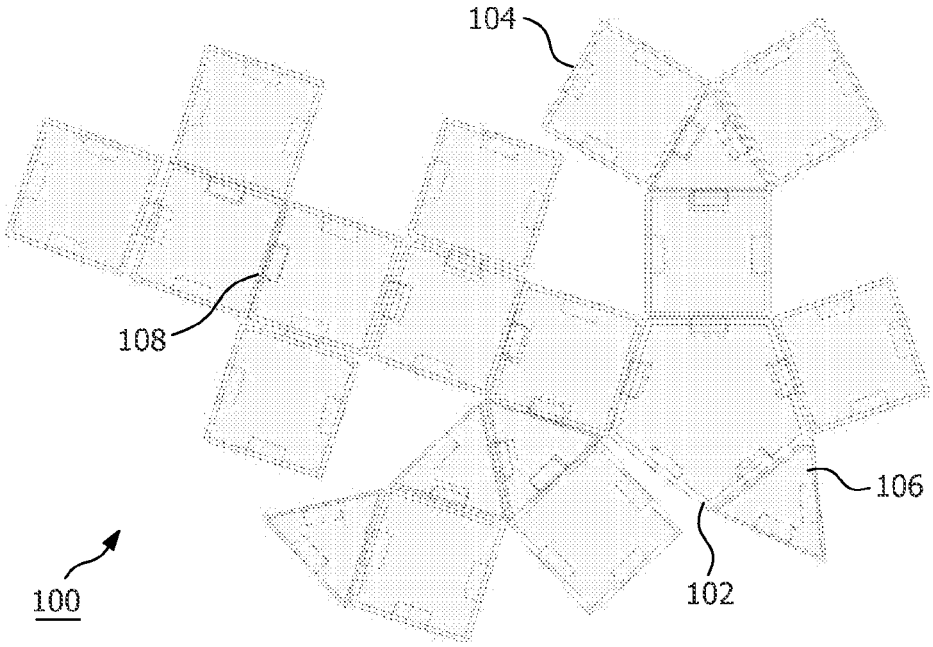
FIG. 1 is a schematic view of a freely configurable two-dimensional lighting device.

FIG. 1 is a schematic view of a lighting device 100 with a plurality of light emitting tiles 102, 104 and 106. The light emitting tiles 102, 104 and 106 have various shapes. Light emitting tile 102 has a pentagonal shape, light emitting tiles 104 a square shape and light emitting tiles 106 are triangular.

Each light emitting tile 102, 104 and 106 is connected to at least one further light emitting tile 102, 104 and 106. It is to be noted that also light emitting tiles of different shapes may be connected with each other. For example, a triangular light emitting tile 106 may be connected to a pentagonal light emitting tile 102. The connection between two light emitting tiles 102, 104 and 106 is performed by a connection element 108, which is located between two connected tiles.

The connection element 108 connects two neighboring light emitting tiles 102, 104 and 106 by connecting an interface element of a first light emitting tile with an interface element of a second light emitting tile. Each tile has on each side one interface element 110. Thus, the tiles 102, 104 and 106 are adapted to be connected to other light emitting tiles 102, 104 and 106 by connecting interfaces 110 of the light emitting tiles 102, 104 and 106 with a connection element 108.

The shape of the tiles 102, 104, 106 is preferably of polygon type with at least 3 or more sides like an equilateral triangle 106 or a square 104. Every side of a tile comprises an interface 110, which allows to connect the tiles with each other using a connection element 108. Depending on how the tiles are connected a great variety of mosaic like lighting devices 100 with different shapes can be realized.

Electrically the lighting device 100 is organized in such a way that all tiles 102, 104, 106 are connected to a power and communication bus. The communication bus is of daisy chain type using standard solutions. All tiles 102, 104, 106 can be controlled individually determining the color and the intensity of the emitted light, preferably with a central controller, which is connected to the bus system. As a light source the individual tiles comprise preferably one or more LEDs or monolithic OLED devices of desired shape.

A daisy chain bus while easily scalable with an almost unlimited number of nodes (tiles) has the drawback, however, that no loops or stubs are allowed. This implies a careful re-design of the bus system when the number of tiles and/or shapes of the tiles of the lighting device are changed.

Tiles 102, 104, 106 with interfaces 110 and connection elements 108 automatically extend and/or modify the bus system when the shape of the lighting device is changed e.g. by varying the number of connected tiles 102, 104, 106 and/or the shape of individual tiles 102, 104, 106 and/or their geometrical orientation.

It is to be noted that not every interface element of a light emitting tile 102, 104 or 106 must be connected to another light emitting tile 102, 104 or 106. The internal daisy chain of a tile is closed at the interface 110 when no connection element is connected to the interface 110. If a connection element 108 is connected to an interface 110 the light emitting tile 102, 104 or 106 has an input port and an output port at the interface element 110 being connected to the connection element 108. By connecting two light emitting tiles 102, 104 or 106 with each other the input port of one light emitting tile is connected to the output port of the other light emitting tile and vice versa. By this architecture a daisy chain bus is leading through every light emitting tile 102, 104 and 106.

Figure 2:
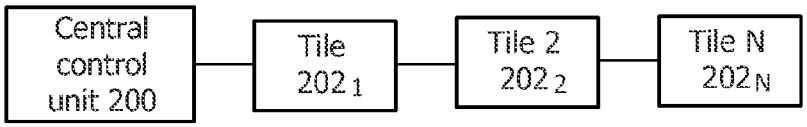
FIG. 2 is a schematic view of the daisy chain bus connecting a plurality of tiles.

FIG. 2 is a schematic view of a daisy chain bus system according to embodiments of the invention. A central control unit 200 is connected via the daisy chain bus to every tile $\mathbf{202}_{1\text{-}n}$. The central control unit 200 is adapted to control the power and/or the color of each tile $\mathbf{202}_{1\text{-}n}$. For changing the power and/or the color of a light emitting tile $\mathbf{202}_{1\text{-}n}$ the central control unit 200 transmits a signal via the daisy chain bus to the corresponding tile, for example tile $\mathbf{202}_2$. The signal being transmitted to tile $\mathbf{202}_2$ must be transmitted through tile $\mathbf{202}_1$ because of the daisy chain bus system. When the signal reaches the addressed tile $\mathbf{202}_2$, a controller in tile $\mathbf{202}_2$, adapts the power and/or the color of the tile $\mathbf{202}_2$ to the power and/or the color being indicated by the signal being transmitted from the central control unit 200.

Figure 3:
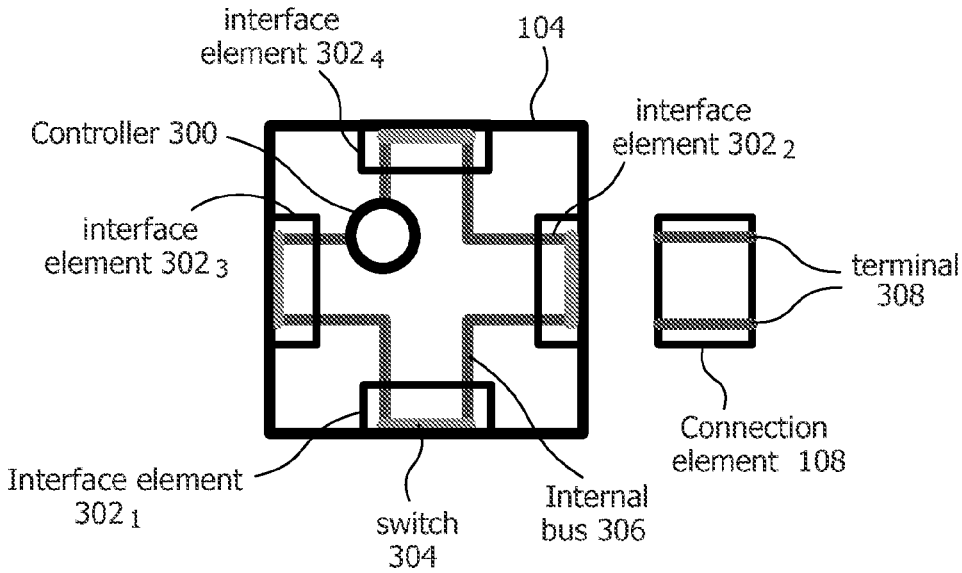
FIG. 3 is a schematic view of a light emitting tile comprising a controller and four interface elements and a connection element.

FIG. 3 is a schematic view of a light emitting tile 104 comprising a controller 300, four interface elements $\mathbf{302}_{1\text{-}4}$, each interface element $\mathbf{302}_{1\text{-}4}$ having a switch 304. Light emitting tile 104 comprises also an internal bus 306. The bus comprises a plurality of electrical conductors connecting the switches 304 in the interface elements $\mathbf{302}_{1\text{-}4}$. When all switches 304 are closed, as it is the case in FIG. 3, the internal bus 306 forms a daisy chain bus with controller 300. Next to light emitting tile 104 a connection element 108 is depicted in FIG. 3. The connection element 108 is adapted to be connected to an interface element $302_{1-4}$ of light emitting tile 104. When the connection element is connected to an interface element $302_{1-4}$ the switch 304 of the corresponding interface element $302_{1-4}$ is opened and the connection element has two terminals 308. The terminals 308 are also referred to as input and output port.

If there is no connection element 108 attached to the tile 104 the internal bus forms electrically a closed loop. This loop is electrically opened utilizing the interface switches 304. When a connection element 108 is docked to one of the tile's 104 interface elements 110 the corresponding switch 304 is opened and the previously closed bus loop is opened and extended to the connection element terminals 308.

Figure 4A:
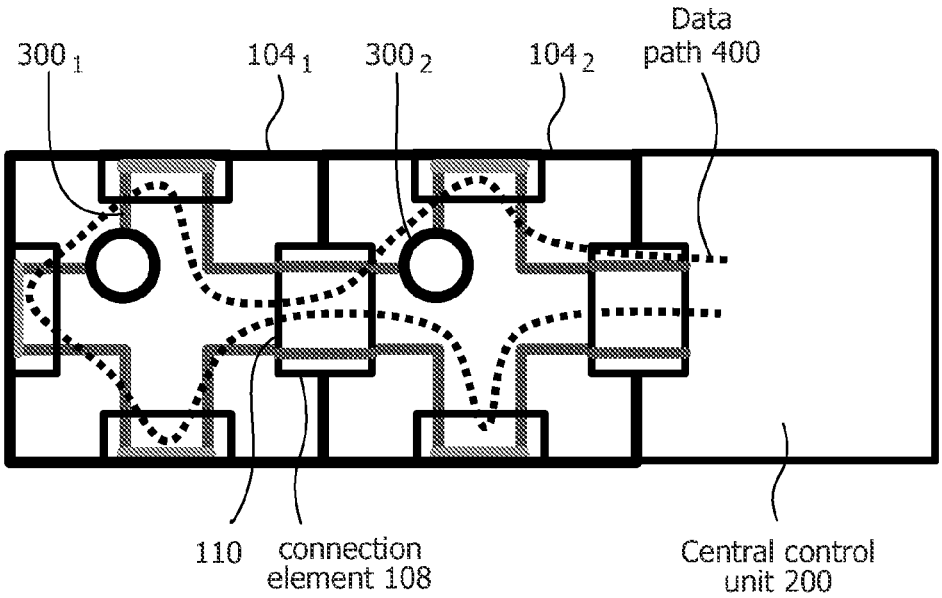
FIG. 4 is a schematic view of two light emitting tiles being connected in a daisy chain bus.

FIG. 4*a* is a schematic view of two light emitting tiles $104_1$ and $104_2$ connected to each other with a connection element 108. Additionally the light emitting tile $104_2$ is connected to a central control unit 200. The connection element 108 connects the light emitting tiles $104_1$ and $104_2$. For doing so, the connection element 108 opens mechanically or electrically the switch in the interface element 110 at each light emitting tile $104_1$ and $104_2$. As explained above, when the switch of an interface element is opened a connection element has an input and an output port. Because switches in both tiles $104_2$ and $104_2$ are opened both tiles are connected to the connection element 108 and both tiles have an input and an output port at the connection element 108. The input port of $104_1$ is connected to output port of tile $104_2$. The input port of tile $104_2$ is connected to output port of tile $104_1$. The connection of tile $104_2$ with central control unit 200 is performed in a similar way. Another connection element 108 is connected to tile $104_2$ and connects tile $104_2$ to central control unit 200. For connecting tile $104_2$ to central control unit 200 again the corresponding switch is opened. By connecting the tiles $104_2$ and $104_1$ with central control unit 200 in this way a data path 400 is established leading in a daisy chain from central control unit 200 through light emitting tile $104_2$ and the corresponding controller $300_2$ to light emitting tile $104_1$ and the corresponding controller $300_1$ back through light emitting tile $104_2$ to the central control unit 200.

This is only possible because switches in interface elements which are connected to connection elements are opened and switches in interface elements which are not connected to connection elements are closed. By this principle a daisy chain bus is established from the central control unit 200 through the two light emitting tiles $104_1$ and $104_2$. Through the daisy chain bus signals may be transmitted which are adapted to trigger a change in power and/or color of the light emitting tiles $104_1$ and $104_2$. Therefore, the two controllers $300_1$ and $300_2$ are adapted to receive signals from central control unit 200 via data path 400. Further, the controllers $300_1$ and $300_2$ are adapted to change the power and/or the color of light emitting devices $104_1$ and $104_2$. Thereby, controller $300_1$ is responsible for light emitting tile $104_1$ and controller $300_2$ is responsible for light emitting device $104_2$.

The result of this interconnect is that a data path 400 is automatically created which starts at a 1st terminal of the connection element connecting central control unit 200 with tile $104_2$ and is further extended by the internal bus of tile $104_2$ and is further extended by connection element 108 connecting tile $104_1$ with tile $104_2$ to the internal bus of tile $104_1$. From here the data path extends back through both tiles $104_{1-2}$ back to a second terminal of the connection element connecting tile $104_2$ with central control unit 200.

Figure 4B:
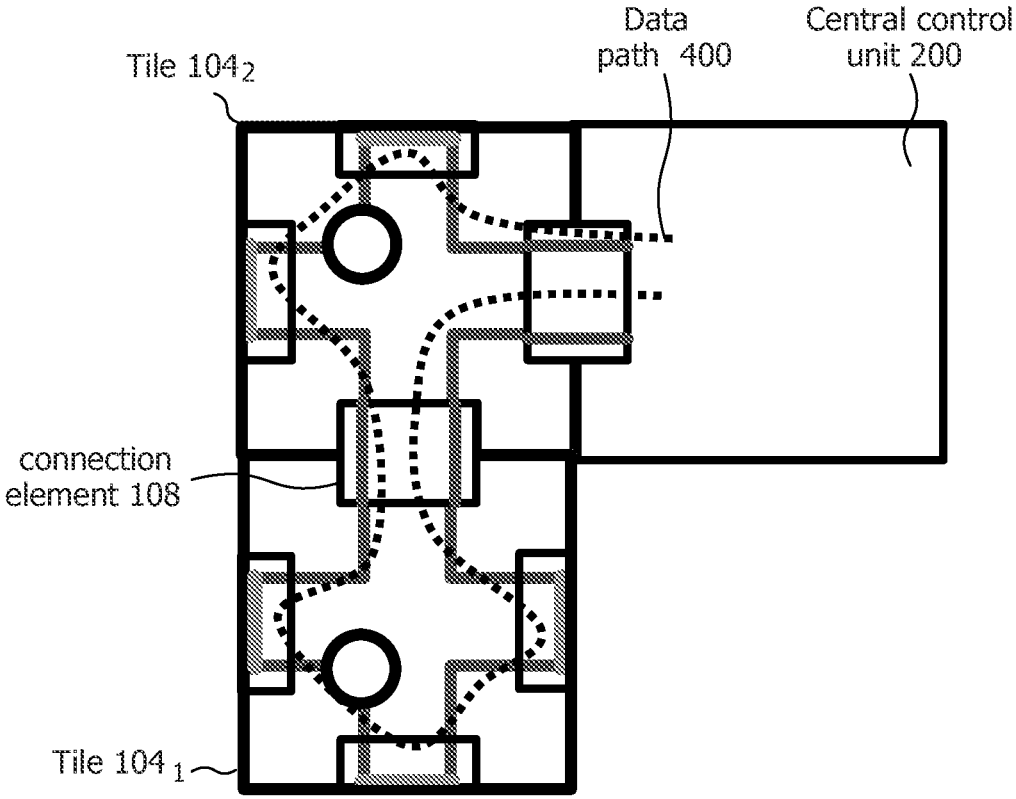

FIG. 4*b* shows a schematic view of two light emitting tiles $104_1$ and $104_2$ being connected to each other; tile $104_2$ is also connected to central control unit 200. The connections are performed by connection elements 108. Generally, the embodiment of FIG. 4*b* is similar to the embodiment of FIG. 4*a*. The main difference is that two neighboring interface elements of tile $104_2$ are connected to tile $104_1$ and the central control unit 200. This means, that an angle of 90 degrees is realized between the connection to the central control unit 200 and the connection to tile $104_1$. This shows that any tile 104 can be connected to any interface element of tile $104_2$. The same applies for central control unit 200. Thus, different shapes of the lighting device are possible to be realized.

Figure 5:
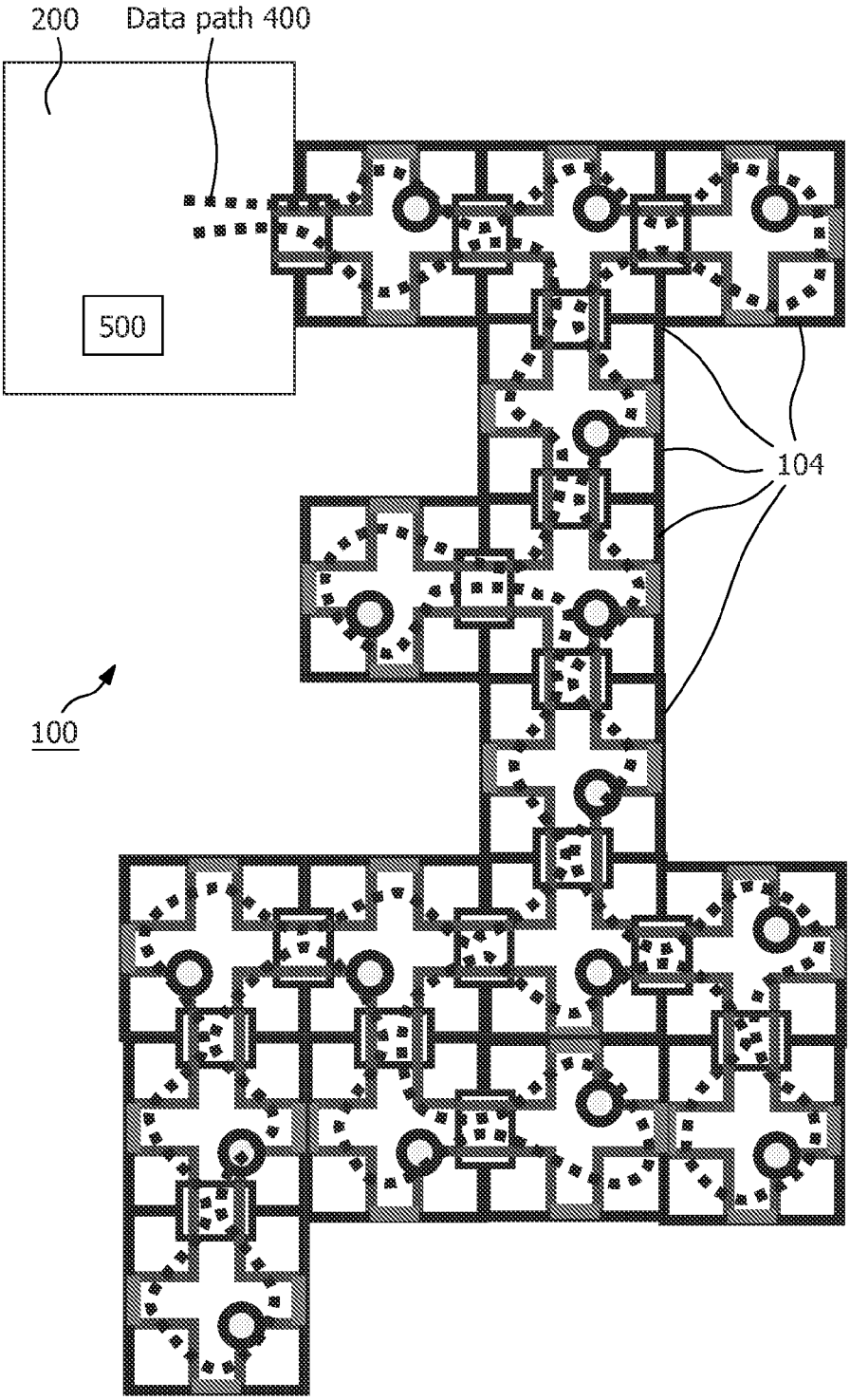
FIG. 5 is a schematic view of a lighting device comprising a plurality of light emitting tiles being connection in a daisy chain bus.

FIG. 5 is a schematic view of a lighting device 100 comprising a plurality of light emitting tiles 104. The light emitting tiles 104 are connected with connection elements as described above. Each light emitting tile 104 comprises four interface elements, each interface element comprising a switch. Further, each light emitting tile comprises a controller 300 being adapted to control the power and/or the color of the corresponding light emitting tile. Each controller 300 controls the power and/or the color of the light emitting tile 104 in which the controller 300 is located.

By connecting neighboring light emitting tiles 104 with connection elements any shape of the lighting device can be realized. It is to be noted that not every light emitting tile 104 is connected to all of its neighbors. When connection elements are added between two neighboring light emitting tiles 104 care must be taken that the data path stays a daisy chain bus 400 as described above. By adding a connection element at the wrong place the whole daisy chain bus 400 may be destroyed. This would lead to a non-working lighting device 100. Optionally, the central control unit 200 comprises a display 500. Central control unit 200 monitors the daisy chain data path 400. When the user destroys the daisy chain data path 400 the central control unit 200 indicates this on display 500. Then, the user knows that the last rearrangement destroyed the daisy chain data path 400.

In case of a working daisy chain data path 400 as in FIG. 5, the central control unit 200 is adapted to send a signal through the light emitting tiles 104 to a certain controller. The signal may comprise indications about the power and/or the color of the corresponding light emitting tile comprising the controller addressed by the central control unit 200. Because each tile 104 has a controller the power and/or the color of each light emitting tile can be controlled individually. For example, the central control unit 200 addresses the third controller in the daisy chain to increase power and change the color. Therefore, the signal is transmitted through the whole daisy chain 400 but only the third controller is addressed. The signal being transmitted from central control unit 200 to a controller comprises the power and/or the wanted color of the light emitting tile 104. When the signal is received by the third controller, the power and/or the color of the light of the corresponding light emitting tile is changed. The third controller is adapted to change the power and/or the color of the light emitting tile, in which the third controller is located.

Figure 6:
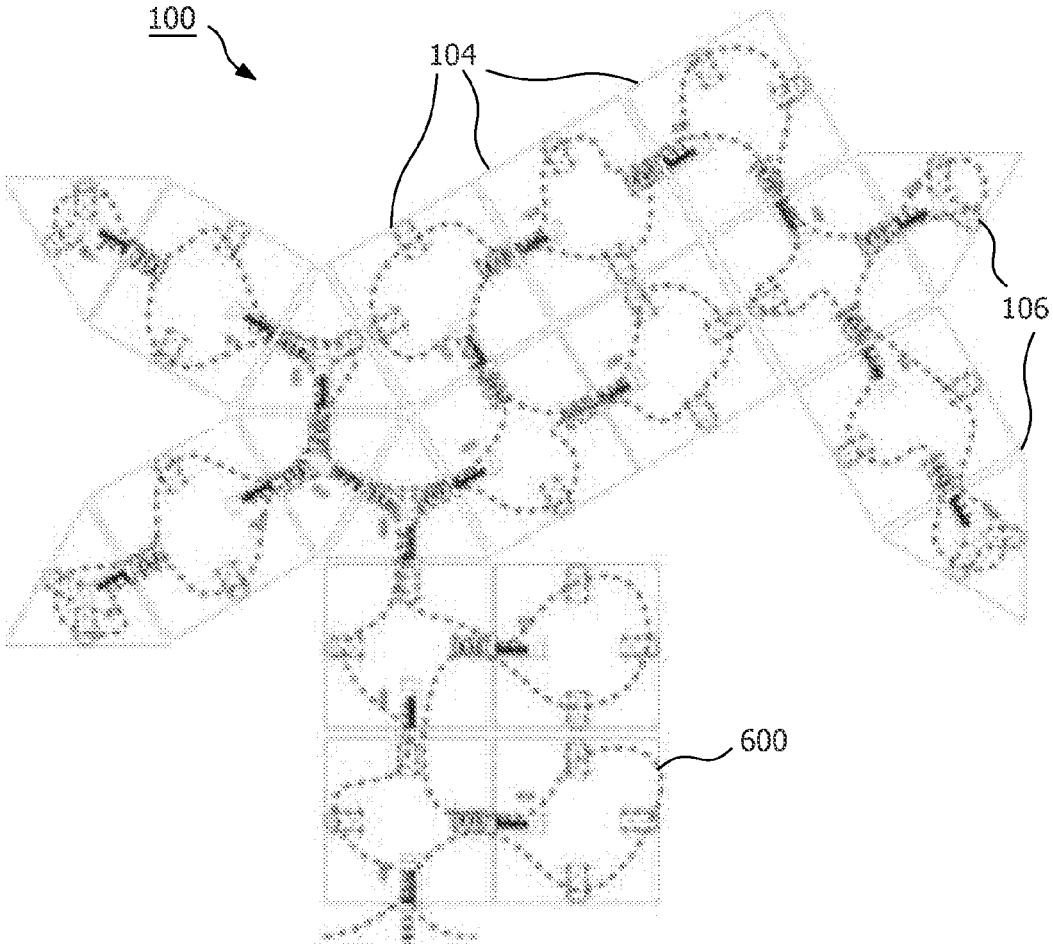
FIG. 6 is a schematic view of a plurality of light emitting tiles forming a lighting device.

FIG. 6 is a schematic view of a lighting device 100 with a plurality of light emitting tiles with four sides 104 and a plurality of light emitting tiles 106 in triangular shape. By adding connection elements between some of the light emitting tiles 104 and 106 a daisy chain data path 600 is established through every tile of the plurality of tiles 104 and 106. FIG. 6 shows that in principle any kind of shape of the lighting device 100 can be realized by connecting light emitting tiles of different shapes 104 and 106. Care must be taken not to interrupt the daisy chain data path 600.

Figure 7:
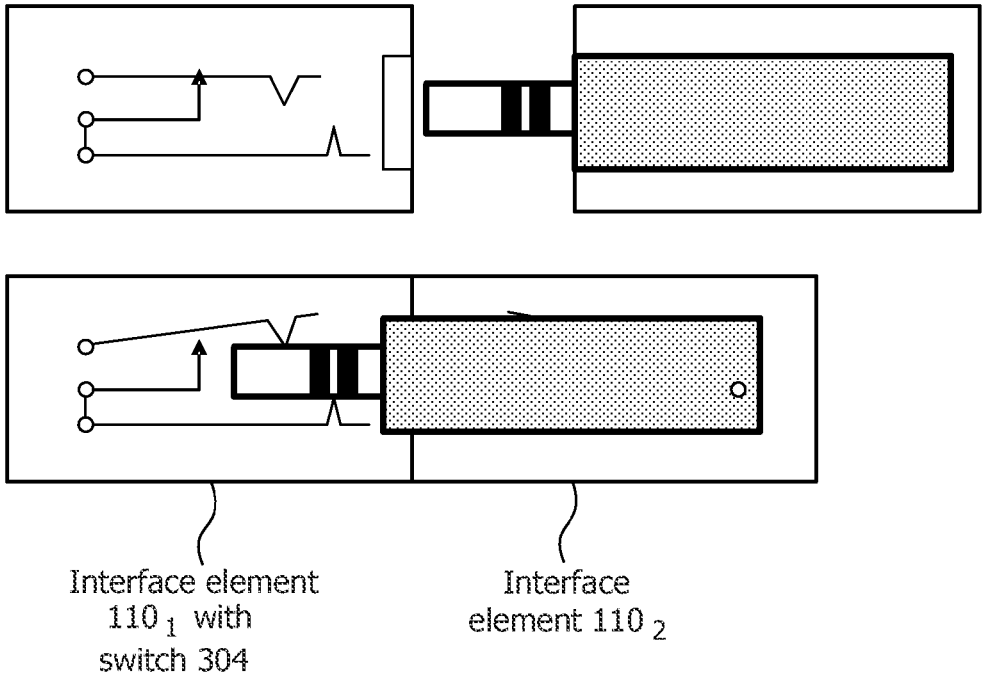
FIG. 7 is a schematic view of a mechanical switch.

FIG. 7 is a schematic view of two interface elements $110_1$ and $110_2$ with switch 304. This is an example for mechanically switching switch 304 when the two neighboring tiles are connected. When the two interface elements $\mathbf{110}_1$ and $\mathbf{110}_2$ are connected the switch 304 is automatically opened. This leads to a daisy chain bus leading through interface element $\mathbf{110}_1$ and $\mathbf{110}_2$. If the two interface elements $\mathbf{110}_1$ and $\mathbf{110}_2$ are not connected, switch 304 is closed and no output port or input port is available at interface element $\mathbf{110}_1$.

The interface elements $\mathbf{110}_{1\text{-}2}$ in FIG. 7 comprise a connection where the female connector has an integrated switch 304. The female switch is used for the tile interface $\mathbf{110}_1$. The male connector is then used as the connection element. When the male connector is plugged into the female connector the internal switch 304 is mechanically opened. Female connectors without a male plug have their corresponding switch 304 closed.

Figure 8:
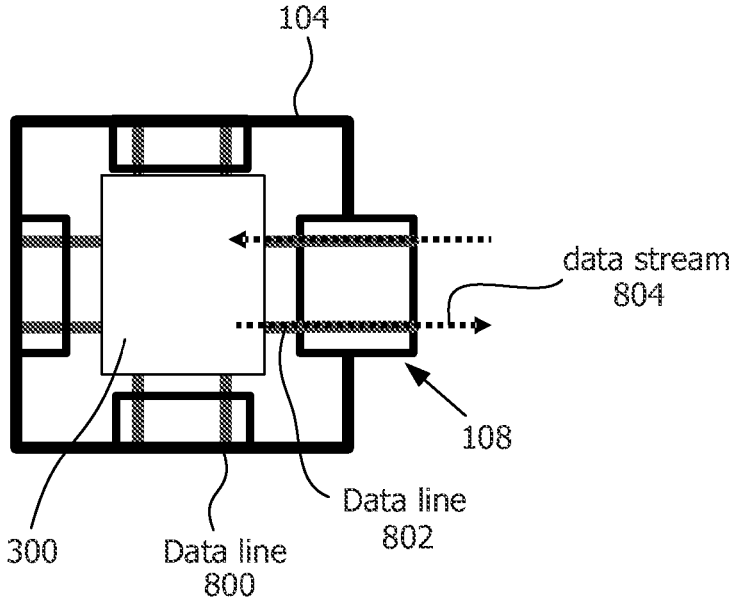
FIG. 8 is a schematic view of a light emitting tile with an electronic switch.

FIG. 8 is a schematic view of a light emitting tile 104 with a controller 300. The controller 300 controls the switches of the light emitting tile 104 electrically. Therefore, controller 300 may receive a signal via the daisy chain bus, the signal being indicative of switching a switch. Several data lines 800 and 802 lead away from the controller to the interface elements. When a connection element 108 is added to an interface element the controller 300 opens the corresponding switch for establishing a data stream to and from the neighboring light emitting tile. By doing so a daisy chain bus system is established.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

LIST OF REFERENCE NUMERALS

| | |
|---|---|
| 100 | Lighting device |
| 102 | Light emitting tile |
| 104 | Light emitting tile |
| 106 | Light emitting tile |
| 108 | Connection element |
| 110 | Interface element |
| 200 | Control unit |
| $202_{1\text{-}N}$ | Light emitting tile |
| 300 | Controller |
| $302_{1\text{-}4}$ | Interface element |
| 304 | Switch |
| 306 | Internal bus |
| 308 | Terminal |
| 400 | Data path |

-continued

| | |
|---|---|
| 500 | Display |
| 600 | Daisy chain |
| 800 | Data line |
| 802 | Data line |
| 804 | Data stream |

The invention claimed is:

1. A lighting device comprising a plurality of light emitting tiles, each one of the plurality of light emitting tiles having at least one interface, configured for signal transmission, each tile having electrical conductors connected to the at least one interface, the at least one interface being configured to connect two light emitting tiles of the plurality of light emitting tiles with each other by using a connection element, wherein a shape of each light emitting tile is a polygon with at least three sides, each side includes the interface for connecting the light emitting tiles with each other, wherein the plurality of light emitting tiles is connected by means of the at least one interface and connection elements to form a light emitting surface connected by a daisy chain bus system, the daisy chain bus system being adapted for transmitting signals, the signals being indicative of power and/or colour of each light emitting tile, wherein the electrical conductors in each tile of the plurality of light emitting tiles are arranged according to a daisy chain bus scheme, wherein each of the at least one interface comprises a switch, the daisy chain bus of one tile of the plurality of light emitting tiles being closed only if each switch is closed, the switch of the at least one interface being opened when a connection element is connected to the at least one interface, the daisy chain bus of each tile of the plurality of light emitting tiles having one input and one output port per opened switch, the input and the output port being connected to the connection element.

2. The lighting device of claim 1, wherein the light emitting tiles comprise organic light emitting diodes or light emitting diodes.

3. The lighting device of claim 1, wherein the light emitting tiles have various shapes.

4. The lighting device according to claim 1, the switch is a mechanical switch.

5. The lighting device according to claim 1, wherein the switch is an electrical switch.

6. The lighting device of claim 1, wherein each light emitting tile comprises a controller connected to the daisy chain bus system.

7. The lighting device of claim 6, the controller of a light emitting tile being adapted to control power and/or colour of the light emitting tile.

8. The lighting device of claim 6, wherein a control unit is connected to the daisy chain bus system, the control unit being adapted to send signals to the controllers of the light emitting tiles via the daisy chain bus system, the signals being indicative of power and/or colour of the light emitting tiles.

9. The lighting device of claim 8, wherein the control unit comprises a display, the display being adapted to indicate if the light emitting tiles are connected properly.

* * * * *